United States Patent [19]

Gibson

[11] Patent Number: 4,756,986

[45] Date of Patent: Jul. 12, 1988

[54] MIXED PIGMENT SYSTEM FOR MODULATION OF TONER GAMMA

[75] Inventor: George A. Gibson, Endwell, N.Y.

[73] Assignee: Savin Corporation, Stamford, Conn.

[21] Appl. No.: 903,368

[22] Filed: Sep. 3, 1986

[51] Int. Cl.[4] ..... G03G 9/12

[52] U.S. Cl. ..... 430/114; 430/115

[58] Field of Search ..... 430/137, 110, 111, 115, 430/114

[56] References Cited

U.S. PATENT DOCUMENTS 4,345,015 8/1982 Hendriksma et al. ..... 430/111

4,568,625 2/1986 Uchiyama et al. ..... 430/122

*Primary Examiner*—John L. Goodrow

*Attorney, Agent, or Firm*—Biebel, French & Nauman

[57] ABSTRACT

An electrophotographic liquid toner composition having lower saturation density and method of reducing the saturation density comprising a toner particle formed from a resin, a solid pigment, and a transparent filler, said pigment and said transparent filler having similar surface energies such that they impart similar triboelectric charging properties to said composition, and said composition is further characterized in that the triboelectric properties of said composition are substantially equivalent to the triboelectric properties of a reference composition in which said filler is not present and in which the combined amount of said pigment is equal to the amount of pigment in said reference composition, and in that said transparent filler lowers the saturation density of said composition so that the saturation density of said composition is lower than the saturation density of said reference composition.

12 Claims, 1 Drawing Sheet

MIXED PIGMENT SYSTEM FOR MODULATION OF TONER GAMMA

BACKGROUND OF THE INVENTION

The present invention relates to an electrophotographic toner composition, and more particularly, to an electrophotographic toner composition providing lower gamma.

Numerous considerations exist in designing a toner composition useful in electrophotography. Toners are usually made of resins or resin blends in which a pigment such as carbon black is dispersed. The toner is designed to accept a charge of the correct polarity. In dry toners, this occurs when the toner is brought into rubbing contact with a carrier material, a ferromagnetic fiber of a magnetic brush, or the like. In liquid toners, the charge is acquired from the suspending liquid. In the reproduction of high contrast copies such as letters by cascade development, it is desirable to select toner particles and carrier materials so that their mutual electrification is governed in most cases by the distance between their relative positions in the triboelectric series. When otherwise compatible toner particles and carrier materials are removed from each other in the triboelectric series by too great a distance, the resulting images are very faint because the attractive forces between the carrier and toner particles compete with the attractive forces between the electrostatic latent image and the toner particles.

Most office copiers operate at a relatively high gamma to improve the reproduction of light pencil lines and other low contrast images which are of importance in this environment Gamma is conventionally defined as the slope of the linear part of a tonal reproduction curve wherein input density is plotted on the abscissa and the output density is plotted on the ordinate. The saturation density occurs beyond the linear region where an increase in input density produces no increase in output density. Electrophotographic toner compositions which provide relatively high gamma are unsuitable for use in several processes including reproduction of continuous tone images, e.g., photographs, and, in the presence of machine jitter, half tones. Thus, the need exists for an electrophotographic toner composition providing lower gamma and meeting the aforementioned considerations.

DEFINITIONS

The terms "pigment" and "filler" as used herein are mutually exclusive. A "pigment" is used herein to refer to the colored particulate which imparts color to the toner. The term "filler" refers to the transparent or colorless material which is used herein as a replacement for the toner.

SUMMARY OF THE INVENTION

The present invention provides an electrophotographic toner composition which provides lower gamma as a result of lowering the saturation density and which is suitable for use in several processes including reproduction of continuous tone materials and half tones.

The electrophotographic toner composition of the present invention provides lower gamma by reducing the saturation density by decreasing the pigment concentration in the toner particles. It has been found that pigment cannot simply be removed from the toner particles to reduce the saturation density of the toner composition because the toner particles will not retain the same triboelectric charging characteristics and the toner composition may not be compatible with the copier design. It has been found that the portion of pigment removed to reduce saturation density must be replaced with a secondary transparent filler selected so as to have a surface chemistry and surface energy similar to that of the removed pigment.

Thus, an object of the present invention is to provide an electrophotographic toner composition providing lower gamma.

A further object of the present invention is to provide an electrophotographic toner composition useful in the reproduction of continuous tone images and half tones.

Another object of the present invention is to provide an electrophotographic toner composition having stable triboelectric charging properties.

A further object of the present invention is to provide a toner containing a transparent filler which is similar in surface chemistry and energy to carbon black.

The present invention provides an electrophotographic toner composition comprising a resin, a pigment, and a transparent filler, said pigment and said transparent filler having similar surface energies such that they impart similar triboelectric charging properties to said compositions.

Other objects and advantages of the present invention will be apparent from the following description and the appended claims.

BRIEF DESCRIPTION OF THE DRAWINGS

The FIGURE provides tonal reproduction curves for a toner in accordance with the present invention and a comparison toner.

DETAILED DESCRIPTION OF THE INVENTION

Figure 1:
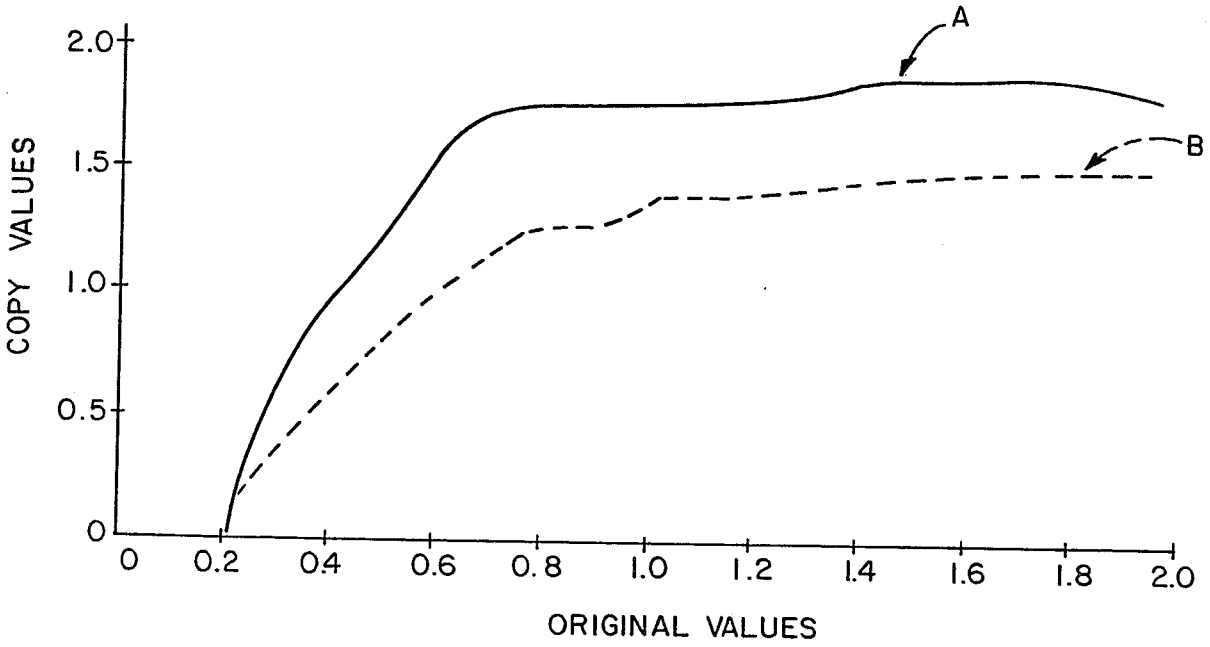

Toner compositions comprising resin and pigment are known in the art. U.S. Pat. Nos. 3,969,251; 4,142,981 and 4,426,436 teach a preferred toner composition comprising a resin with a relatively high percentage of styrene, and carbon black. U.S. Pat. No. 4,049,447 teaches a toner composition wherein the resin comprises an amorphous, low-melting aromatic polyester and a pigment such as carbon black, Monastral blue or Monastral red. U.S. Pat. No. 4,469,770 teaches a toner composition. comprising a styrene butadiene copolymer resin and a pigment such as carbon black or magnetites. U.S. Pat. No. 4,513,074 teaches a developer composition comprising a first resin of styrene methacrylate copolymers grafted with or containing a low molecular weight wax composition, a second resin of styrene, acrylate, acrylonitrile terpolymer, and carbon black. The toner of the present invention is characterized in that a portion of the pigment is replaced by a transparent filler.

The electrophotographic toner composition of the present invention provides lower gamma by decreasing the saturation density of the toner composition. It has been found that the saturation density can be effectively reduced by decreasing the pigment concentration of the toner particles. By removing a portion of the pigment and replacing the removed pigment with a secondary filler which has a surface chemistry and energy similar to that of the removed pigment, the saturation density is lowered which results in a lower gamma.

In selecting a filler which is useful in the present invention, the structuring effect of the filler on the resin must be considered in order to maintain the same triboelectric charging properties. Those in the art will understand that the charging characteristics of a toner are a product of several factors including the resin and pigment in the toner and the structuring effect which the pigment has on the toner resin. To be useful as a pigment replacement, the filler must have the same or a very similar structuring effect as the removed pigment on the resin.

To be useful as a transparent (colorless) replacement for a toner pigment, the filler must have a surface energy comparable to that of the replaced pigment. Alternatively stated, the surfaces of the pigments and fillers should have similar functional groups. Similarity or equivalence in terms of hydrogen bonding ability, acid strength ($_pk_A$) and overall polarity are desired. Typically, toner pigments are hydrophilic materials and, more particularly, acidic. Thus, in replacing an acidic pigment, the filler must also be acidic. A hydrophilic filler with acidic hydrogens is particularly useful. Typically, hydrophilic fillers have a relatively high surface energy. Hydrophobic pigments have also been used in toners. In replacing a graphitized pigment, a hydrophobic filler is particularly useful. Typically, hydrophobic fillers have a relatively low surface energy.

Additionally, to be useful in the toner composition of the present invention which provides lower gamma, the filler must be transparent. By "transparent" is meant that there is a close enough match of the index of refraction of the filler and the resin that the filler essentially disappears into the other components of the toner composition so that the toner has reduced saturation density. The transparent nature of the filler is critical in providing lower gamma.

Any transparent filler which has the same surface energy and the same structuring effect on the resin as the removed pigment is useful in the present invention. Useful fillers include quartz, silicas and silica gels, mica and silica based glasses. Preferred fillers include hydrophilic silicas and aluminas with acidic surface hydrogen.

In replacing a portion of the pigment with filler, the combined amount of pigment and filler should approximately equal the total amount of pigment in the reference toner to obtain similar charging characteristics. Thus, the combined amount of pigment and filler in the present invention is about 1 to 35% by weight of the resin. To be useful in providing a toner composition providing lower gamma, the weight ratio of filler to pigment must be carefully controlled. The weight ratio of the filler to pigment is about 1:10 to 10:1.

Any conventional pigment is useful as the colorant for the toner particles. Examples of useful pigments are Monastral Blue G (C.I. Pigment Blue 15 C.I. No. 74160), Toluidine Red Y (C.I. Pigment Red 3), Quindo Magenta (Pigment Red 122), Indo Brilliant Scarlet Toner (Pigment Red 123, C.I. No. 71145), Toluidine Red B (C.I. Pigment Red 3), Watchung Red B (C.I. Pigment Red 48), Permanent Rubine F6B13-1731 (Pigment Red 184), Hansa Yellow (Pigment Yellow 98), Dalamar Yellow (Pigment Yellow 74, C.I. No. 11741), Toluidine Yellow G (C.I. Pigment Yellow 1), Monastral Blue B (C.I. Pigment Blue 15), Monastral Green B (C.I. Pigment Green 7), Pigment Scarlet (C.I. Pigment Red 60), Auric Brown (C.I. Pigment Brown 6), Monastral Green G (Pigment Green 7), Carbon Black (Cabot Mogul L), and Stirling NS N 774 (Pigment Black 7, C.I. No. 77266).

If desired, a finely ground paramagnetic material such as metals including iron, cobalt, nickel, various magnetic oxides including $Fe_2O_3$, $Fe_3O_4$, and other magnetic oxides; certain ferrites such as zinc, cadmium, barium, manganese; chromium dioxide; various permalloys and other alloys such as cobalt-phosphorus, cobalt-nickel and the like; or mixtures of any of these may be used as a pigment.

In selecting the resin, the resin must be capable of dispersing the pigment-and filler to develop the proper color. Typically, an acidic pigment is used. Following the Lewis acid-base theory, the resin used with an acidic pigment should be basic to maximize the interaction between the resin, and pigment and filler to achieve the best dispersion possible in the toner particles.

A resin must be selected to provide the proper triboelectric relationship with a carrier. Generally, the resin governs the triboelectric charging properties of the toner particles. If the resin and carrier are too far removed in the triboelectric series, the resulting images are very faint because the attractive forces between the toner particles and carrier compete with the attractive forces between the electrostatic latent image and the toner particles. Thus, the distance between the resin and carrier relative positions in the triboelectric series must be considered when selecting a resin. Additionally, the resin must be capable of being easily cleaned from the electrophotographic plate without sticking and have a melting point within the proper range for heat fixing, i.e. 105° to 150° C.

Conventionally used or known toner resins are useful in the toner of the present invention. Representative of useful resins are polyesters (see U.S. Pat. No. 4,049,447), vinyl resins and, more particularly, styrene resins (see U.S. Pat. No. 3,969,251), ethylene-vinyl acetate copolymers (e.g., ELVAX II (trademark) resins manufactured by E.I. du Pont de Nemours & Company). Other useful polymers are isotactic polypropylene (crystalline) and low molecular weight polyamide (Versamid 335). Other polymers which are usable are polybutyl teraphthalate, and poly (4-methyl pentene).

Another class of useful polymers are those manufactured by E.I. du Pont de Nemours & Company and sold under the trademark ELVACITE. These are methacrylate resins, such as polybutyl methacrylate (Grade 2044), polyethyl methacrylate (Grade 2028) and polymethyl methacrylate (Grade 2041).

The resin may also be blended with one or more other resins to form a mixture of resins if desired.

A charge director is added to the toner composition to allow the particles to acquire a net of electrostatic charge; otherwise, the toner particles are not useful for electrophoresis. The amount and type of charge director which will be useful depends on the toner particles'-surface which is determined by the structuring effect of the pigment and filler on the resin.

The charge director may impart either a positive or a negative charge to the toner particles depending on the charge of the latent image. Those in the art will understand that the charge on the toner particles must be opposite in polarity to that carried by the latent electrostatic image.

The charge director is typically present in an amount of about 1 to 1000 mg per gram of toner solids. Useful charge directors include lecithin, a metal salt of naphthenic acid, an alkylbenzenesulfonate, a dialkylnaphthalenesulfonate, a mono or di-alkylsulfosuccinate, a dialkylphosphate, linseed oil, soybean oil, an alkyd resin and the like.

The toner composition of the present invention can be prepared by any well known toner mixing technique. For example, the ingredients can be thoroughly mixed by blending and milling the components and thereafter micropulverizing the resulting mixture. Another well known technique for forming toner particles is to spray dry or freeze dry a suspension, a hot melt, or solution of the toner composition.

The toner may have an average particle diameter of about 0.1 to 100 microns, but the present invention is useful in larger and smaller particle size toners as well. Toner size will vary with the development procedure. For liquid toners diameters of about 0.1 to 10 microns are typical. In dry toners a larger particle size is used.

The toner particle must be capable of accepting a charge of the correct polarity when brought into rubbing contact with the surface of carrier materials in cascade or touchdown development systems. The toner particles must have a triboelectric polarity opposite to that of the carrier materials. As those skilled in the art know, in order to develop a negatively charged electrostatic latent image, a toner particle and carrier combination should be selected in which the toner particles are triboelectrically positive in relation to the carrier. Conversely, to develop a positively charged electrostatic latent image, the toner particles and carrier should be selected so that the toner particles are triboelectrically negative in relation to the carrier.

Useful carrier materials are isomerized aliphatic hydrocarbons and more particularly ISOPAR-G, ISOPAR-H, ISOPAR-K, ISOPAR-L, and ISOPAR-M These ISOPARS are narrow cuts of isoparaffinic hydrocarbon fractions with extremely high levels of purity. For example, the boiling range of ISOPAR-G is between 156° C. and 176° C. ISOPAR-L has a mid-boiling point of approximately 194° C. ISOPAR-M has a flash point of 77° C. and an auto-ignition temperature of 338° C. Stringent manufacturing specifications limit sulfur, acids, carboxyl, and chlorides to a few parts per million. They are substantially odorless, possessing only a very mild paraffinic odor. They have excellent odor stability and are all manufactured by the Exxon Corporation. Light mineral oils, such as MARCOL 52 or MARCOL 62, manufactured by the Humble Oil and Refining Company may be used. These are higher boiling aliphatic hydrocarbon liquids.

All of the carrier liquids have an electrical volume resistivity in excess of $10^9$ ohm centimeters and a dielectric constant below 3.0. The vapor pressures at 25° C. are less than 10. The most volatile ISOPAR is ISOPAR-G, which has a flash point, determined by the tag closed cup method, of 40° C. ISOPAR-L has a flash point of 61° C., determined by the same method; ISOPAR-M has a flash point, determined by the Pensky-Martens method, of 77° C. While we have described the preferred liquids, the essential characteristics are the volume resistivity and dielectric constant. In addition, a feature of the liquid carriers is a low Kauri-butanol value in the vicinity of 27 or 28 determined by ASTM D 1133.

The figure shows two tonal reproduction curves. The original density unit values are plotted on the abscissa while the copy density unit values are plotted on the ordinate. Gamma is the slope of the linear part of a tonal reproduction curve. The saturation density occurs above the linear portion of the plot, i.e. where an increase in the original density unit values produces no increase in the copy density unit values. The solid plot (A) is for a toner composition with 100% carbon black, i.e. no transparent filler present. For this toner composition, the saturation density occurs at about an original density unit value of 0.8 and a copy density unit value of 1.7. Gamma equals (1.7–0.1)/(0.8–0.2) or 2.67. The dotted plot (B) is for a toner composition wherein 25% of the carbon black was replaced with a transparent filler. The saturation density occurs at about an original density unit value of 0.8 and a copy density unit value of 1.3. Gamma equals (1.3–0.1)/(0.8–0.2) or 2. Although gamma is a function of a number of factors including the toner composition, these plots indicate that by replacing part of the carbon black with transparent filler, the saturation density can be reduced, and thus, gamma can be lowered. Thus, the toner composition of the present invention is successful in providing lower gamma.

The present invention is illustrated by the following non-limiting example:

EXAMPLE

In a Ross planetary mixer, we combined 50 grams of ELVAX II polymer 5720 and 500 grams of ISOPAR-L at 78° C. After mixing for thirty minutes, 94 grams of carbon black (Mogul L) and 31 grams Cabosil M-5 were added, and mixing was continued for an hour at 82° C. At this time, the addition of 1000 grams of ISOPAR-L was started and continued for one hour. The material was discharged at 90° C. through a 0.5 mm orifice into ice water. This material had the form of a sponge. The sponge was passed through a meat grinder, which shredded the sponge into pieces of a size adapted to pass through a 50 mesh screen. The pieces were then passed to the wet-grinding step. We ground 28.8 grams of the sponge pieces with 171.2 grams of ISOPAR-H for a period of 75.5 hours in a research Type 0-1 attritor (Union Process Company) equipped with tapwater cooling and 3/16-inch steel balls. The grinding pulled the elastomeric polymer particles apart, forming fibers present in concentration. We diluted the concentrate to 2 percent solids and added a charge director to form a developing liquid. The charge director was added to a number of samples in amounts varying from 1 to 100 milligrams per gram of toner solids. A developing liquid was then diluted with ISOPAR-G, so that the toner particles were present in the amount of 0.2 percent by weight in respect of the dispersant ISOPAR, and copies were made on a Savin 870 copier.

Having described the invention in detail and by reference to preferred embodiments thereof, it will be apparent that modifications and variations are possible without departing from the scope of the invention defined in the appended claims

What is claimed is:

1. An electrophotographic liquid toner composition having a lower saturation density comprising a toner particle formed from a resin, a solid pigment, and a transparent filler, said pigment and said transparent filler having similar surface energies such that they impart similar triboelectric charging properties to said composition, and said composition is further characterized in that the triboelectric properties of said composition are substantially equivalent to the triboelectric properties of a reference composition in which said filler is not present and in which the combined amount of said filler and said pigment is equal to the amount of pigment in said reference composition, and in that said transparent filler lowers the saturation density of said composition so that the saturation density of said composition is lower than the saturation density of said reference composition.

2. The composition of claim 1 wherein the combined amount of said pigment and said filler is about 1 to 35% by weight of said resin.

3. The composition of claim 2 wherein the weight ratio of said filler to said pigment is about 1:10 to 10:1.

4. The composition of claim 3 wherein said transparent filler is selected from the group consisting of silica, alumina, quartz, mica, silica gel, and silica based glasses.

5. The composition of claim 4 wherein said pigment is an acidic pigment.

6. The composition of claim 5 wherein said resin is an ethylene-vinylacetate copolymers.

7. The composition of claim 5 wherein said resin is a mixture of resins.

8. The composition of claim 7 wherein said pigment is carbon black.

9. The composition of claim 1 wherein said composition has a saturation density less than 1.7.

10. A method for reducing the saturation density of a liquid toner composition including a resin, and a solid pigment which comprises:

replacing a portion of said pigment with a transparent filler having triboelectric properties similar to the triboelectric properties of said pigment to thereby produce a composition in which the triboelectric properties of said composition are substantially equivalent to the triboelectric properties of a reference composition in which said filler is not present and in which the combined amount of said filler and said pigment is equal to the amount of pigment in said reference composition and in that said replacement of said pigment portion with said transparent filler lowers the saturation density of said composition so that the saturation density of said composition is lower than the saturation density of said reference composition.

11. The method of claim 10 wherein the weight ratio of said pigment to said filler is about 1:10 to 10:1.

12. The method of claim 10 wherein said step of replacing a portion of said pigment with said transparent filler produces a toner having a saturation density less than 1.7.

* * * * *